US010036229B2

(12) United States Patent
Bacsik et al.

(10) Patent No.: US 10,036,229 B2
(45) Date of Patent: Jul. 31, 2018

(54) TIME DELAY TOE SLEEVE

(71) Applicant: Weatherford Technology Holdings, LLC, Houston, TX (US)

(72) Inventors: Ryan R. Bacsik, Houston, TX (US); Jason J. Brasseaux, Cypress, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/042,235

(22) Filed: Feb. 12, 2016

(65) Prior Publication Data

US 2016/0237781 A1 Aug. 18, 2016

Related U.S. Application Data

(60) Provisional application No. 62/115,813, filed on Feb. 13, 2015.

(51) Int. Cl.

| | |
|---|---|
| ***E21B 34/06*** | (2006.01) |
| ***E21B 34/10*** | (2006.01) |
| *E21B 34/00* | (2006.01) |

(52) U.S. Cl.

CPC ..... *E21B 34/063* (2013.01); *E21B 34/10* (2013.01); *E21B 34/108* (2013.01); *E21B 2034/007* (2013.01)

(58) Field of Classification Search

CPC ..... E21B 34/063; E21B 34/10; E21B 34/108; E21B 2034/007

See application file for complete search history.

(56) References Cited

U.S. PATENT DOCUMENTS

| | | | | |
|---|---|---|---|---|
| 4,403,659 | A | 9/1983 | Upchurch | |
| 7,828,067 | B2 * | 11/2010 | Scott | E21B 43/12 166/386 |
| 8,267,178 | B1 | 9/2012 | Sommers et al. | |
| 9,394,773 | B2 * | 7/2016 | Garcia | E21B 34/14 |
| 9,410,399 | B2 * | 8/2016 | Andersen | E21B 34/14 |
| 9,482,069 | B2 * | 11/2016 | Powers | E21B 33/1208 |
| 2008/0066923 | A1 | 3/2008 | Xu | |

(Continued)

OTHER PUBLICATIONS

Weatherford, "ZoneSelect(R) Completions System Time Delay (TD) Toe Sleeve," Brochure, copyright 2013.

(Continued)

*Primary Examiner* — Matthew R Buck
*Assistant Examiner* — Aaron L Lembo
(74) *Attorney, Agent, or Firm* — Blank Rome LLP

(57) ABSTRACT

A downhole tool, such as a toe sleeve, has an insert movably disposed in the housing's bore and sealably enclosing a second part of the communication path from a first port. A barrier disposed between the first and second parts of the communication path is breachable in response to a level of the applied pressure in the housing's bore. At least one retainer is engaged between the insert and the housing and at least temporarily retains the insert toward a closed position. The at least one retainer is at least partially composed of a dissolvable material and at least partially dissolves in response to the applied pressure communicated through the communication path to the second part. The at least one retainer when at least partially dissolved permits the applied pressure to initiate movement of the insert, such as from a closed position toward an opened position.

22 Claims, 6 Drawing Sheets

(56) References Cited

U.S. PATENT DOCUMENTS

2013/0043041 A1* 2/2013 McCoy ..... E21B 34/063 166/373
2013/0133897 A1* 5/2013 Baihly ..... E21B 34/063 166/376
2013/0248193 A1* 9/2013 Brekke ..... E21B 34/063 166/317
2013/0299199 A1 11/2013 Naedler et al.
2014/0020898 A1 1/2014 Holderman et al.
2014/0083689 A1* 3/2014 Streich ..... E21B 34/063 166/250.15
2014/0174757 A1* 6/2014 Fripp ..... E21B 33/12 166/376
2014/0251619 A1 9/2014 George et al.
2014/0251620 A1 9/2014 George et al.
2014/0338923 A1* 11/2014 Fripp ..... E21B 34/063 166/376
2014/0345877 A1* 11/2014 McCoy ..... E21B 34/063 166/373
2015/0218904 A1* 8/2015 Chauffe ..... E21B 33/128 166/250.01
2015/0315873 A1* 11/2015 Mailand ..... E21B 34/125 166/307
2016/0024877 A1* 1/2016 Coronado ..... E21B 33/16 166/177.4
2016/0032683 A1* 2/2016 Wood ..... E21B 43/14 166/308.1
2016/0237785 A1* 8/2016 Bacsik ..... E21B 34/10
2017/0058641 A1* 3/2017 Hardesty ..... E21B 43/14
2017/0058642 A1* 3/2017 Roessler ..... E21B 43/26
2017/0058643 A1* 3/2017 Snider ..... E21B 34/12
2017/0058644 A1* 3/2017 Andreychuk ..... E21B 34/12
2017/0058646 A1* 3/2017 Bernardi ..... E21B 43/01
2017/0058650 A1* 3/2017 Schultz ..... E21B 33/138
2017/0067312 A1* 3/2017 Frazier ..... E21B 33/1208
2017/0067314 A1* 3/2017 Flores Perez ..... E21B 34/10
2017/0067328 A1* 3/2017 Chauffe ..... C04B 35/14

OTHER PUBLICATIONS

Weatherford, "ZoneSelect(R) Atmoshpheric (AC) Toe Sleeve," Brochure, copyright 2013-2014.
Weatherford, "ZoneSelect(R) Rupture Disk (RD) Toe Sleeve," Brochure, copyright 2013.
Weatherford, "ZoneSelect(R) Completions System SMART Toe Sleeve," Brochure, copyright 2014.
Weatherford, "ZoneSelect(R) Toe Sleeve," Brochure, copyright 2009.
Int'l Search Report and Written Opinion in counterpart PCT Appl. PCT/US2016/017658, dated May 31, 2016.

* cited by examiner (Background)

TIME DELAY TOE SLEEVE

CROSS-REFERENCE TO RELATED APPLICATIONS

This application claims the benefit of U.S. Provisional Appl. 62/115,813, filed 13, Feb. 2015, which is incorporated herein by reference.

BACKGROUND OF THE DISCLOSURE

During hydraulic fracturing operations, operators want to minimize the number of trips they need to run in a well while still being able to optimize the placement of stimulation treatments and the use of rig/fracture equipment. Therefore, operators prefer to use a single-trip, multistage fracturing system to selectively stimulate multiple stages, intervals, or zones of a well. Typically, this type of fracturing system has a series of open hole packers along a tubing string to isolate zones in the well. Interspersed between these packers, the system has fracture sleeves along the tubing string. These sleeves are initially closed, but they can be opened to stimulate the various intervals in the well.

As shown in FIG. 1, for example, a tubing string 12 for a wellbore fluid treatment system 20 deploys in a wellbore 10 from a rig 30 having a pumping system 35. The tubing string 12 has sliding sleeves 50 disposed along its length. Various packers 40 isolate portions of the wellbore 10 into isolated zones. In general, the wellbore 10 can be an opened or cased hole, and the packers 40 can be any suitable type of packer intended to isolate portions of the wellbore into isolated zones.

The sliding sleeves 50 deployed on the tubing string 12 between the packers 40 can be used to divert treatment fluid selectively to the isolated zones of the surrounding formation. The tubing string 12 can be part of a fracture assembly, for example, having a top liner packer (not shown), a wellbore isolation valve (not shown), and other packers and sleeves (not shown) in addition to those shown. If the wellbore 10 has casing, then the wellbore 10 can have casing perforations 14 at various points.

As conventionally done, operators deploy a setting ball to close the wellbore isolation valve (not shown) and positively seal off the tubing string 12. Operators then sequentially set the packers 40. Once all the packers 40 are set, the wellbore isolation valve acts as a positive barrier to formation pressure.

At this point, operators rig up the fracturing surface equipment 35 and pump fluid down the wellbore to open a toe sleeve 60 toward the end of the tubing string 12. This treats a first zone of the formation. Then, in later stages of the operation, operators selectively actuate the sliding sleeves 50 between the packers 40 to treat the isolated zones depicted in FIG. 1. In the most common approach, operators actuate the sliding sleeves 50 by dropping successively increasing sized balls down the tubing string 12. Each ball opens a corresponding sleeve 50 so fracture treatment can be accurately applied in each zone up the tubing string 12.

Several types of toe sleeves 60 have been used on tubing strings. In FIG. 2A, for example, a conventional toe sleeve 60, such as Weatherford's ZoneSelect toe sleeve, is a differential opening sleeve normally placed at the bottom or "toe" of the tubing string 12. The toe sleeve 60 is activated when a ball lands on a landing seat 73 on the sleeve's insert 70 and tubing pressure is applied against the seated ball to shear the sleeve's insert 70 free. The sleeve's insert 70 shifts in the housing 62, decreasing the enclosed volume 72. Once this occurs, the sleeve's insert 70 opens past ports 66 in the sleeve's housing 62 and locks in place so flow can be diverted to the wellbore through the open toe sleeve 60 from the housing's bore 64 and out the ports 66.

In FIG. 2B, another type of toe sleeve has a time delay, such as Weatherford's ZoneSelect Time Delay (TD) toe sleeve 60 used in a multizone completion system. Typically placed at the toe of a cemented completion, applied pressure ruptures a disc 68 in this TD toe sleeve 60, which exposes a piston 75 to differential pressure within the toe sleeve 60. The piston 75 moves slowly across concentric inner and outer ports 66*a-b* as the fluid being acted on is metered while passing from a primary chamber to a secondary atmospheric chamber.

The time-delay toe sleeve 60 is run in-hole as part of the tubing string 12. When the optimum setting depth is reached, tubing pressure is applied to check casing integrity and to rupture the disc 68 in the time-delay toe sleeve 60. In this way, the time-delay mechanism (i.e., piston 75, chambers, etc.) meters the toe sleeve's opening and eventually creates a pathway to begin stimulation operations. Depending on the application, the primary stimulation may be performed through the time-delay toe sleeve 60.

The time-delay toe sleeve 60 actuates at or below the casing test pressure, enabling the test pressure to be the highest pressure the system will be exposed to throughout operations. The time-delay toe sleeve 60 can avoid the inherent risk of a standard, hydraulically actuated toe sleeve 60 of FIG. 2A, which may open below a preset value (before pressure test is complete) or may require excessive pressure to open (exceeding casing and surface equipment limitations).

In FIG. 2C, another type of toe sleeve uses an atmospheric chamber to control opening, such as the Weatherford atmospheric chamber (AC) toe sleeve 60 used in a multistage completion system. The AC toe sleeve 60 is typically placed at the toe of the tubing string 12, and the AC toe sleeve 60 is actuated by applied tubing pressure creating enough hydraulic force on the sleeve's insert 70 to shear the insert 70 free of shear pins 76. The insert 70 within the AC toe sleeve 60 then slides past ports 66 in the sleeve's housing 62 and locks open. Preferably, the insert 70 opens upward to prevent a liner wiper dart from inadvertently forcing the sleeve 60 open during earlier operations.

The AC toe sleeve 60 is also run in the wellbore 10 as part of the tubing string 12. When the optimum setting depth is reached, tubing pressure is applied to actuate the openhole packers 40 and test the casing. Additional pressure is then applied to open the AC toe sleeve 60 and initiate communications to the formation for subsequent stimulation operations from the housing's bore 64 and out the ports 66.

In FIG. 2D, yet another type of toe sleeve uses a rupture disc to control operations, such as the Weatherford ZoneSelect Rupture Disc (RD) toe sleeve 60 shown used in a multizone completion. Placed at the toe of the tubing string 12, the RD toe sleeve 60 actuates when applied tubing pressure causes a disc 68 to rupture in the sleeve 60. The insert 70 inside the sleeve 60 then slides past ports 66 in the sleeve's housing 62 and locks in place. After the RD toe sleeve 60 is open, balls or composite plugs can be pumped down to begin stimulation operations. If required, the first stimulation operation can be performed through the open RD toe sleeve 60 from the housing's bore 64 and out the ports 66.

Another toe sleeve, such as the SMART toe sleeve 60 in FIG. 2E, allows the casing string to be tested to its full working pressure with an unlimited hold period and without exceeding the working pressure. Placed at the bottom or toe of the tubing string 12, the SMART toe sleeve 60, which is available from Weatherford, actuates and opens after two internal pressure applications. Once the SMART toe sleeve 60 is open, balls or composite plugs can be pumped downhole for subsequent stimulation.

The sleeve 60 includes a housing 62 with an insert 70 movable in its bore 64. The sleeve 60 has two shear features, including initiation shear screws 80 and arming shear screws 82. The initiation shear screws 80 are set for wellbore conditions, and the arming shear screws 82 have a predetermined value. Multiple low pressure tests can be applied to the closed sleeve 60 as long as the initiation valve for the initiation shear screws 80 is not exceeded. The first working pressure test shears the initiation shear screws 80, allowing the insert 70 to stroke and compress a wave spring 75. A snap ring 84 is partially collapsed during this stroke. After the first test, pressure is vented, and the load from the wave spring 75 shears the activation shear screws 82, which arms the sleeve 60 for the next pressure cycle. When working pressure is then applied, the insert 70 again strokes, which fully collapses the snap ring 84 so that it is no longer active. When the pressure is vented, the spring 75 then fully moves the insert 70 so that the ports 66*a-b* align allowing fluid communication out of the housing's bore 64 to the wellbore.

The SMART sleeve 60 can be used in horizontal and vertical wells, and in cemented and openhole completions. Because the SMART sleeve 60 does not open after the first pressure application, operators can maintain well integrity if issues arise at the surface. Each application of pressure can be held for an indefinite amount of time, enabling two opportunities to satisfy any regulatory requirements. The SMART sleeve 60 locks open, which prevents accidental tool closure caused by intervention tools.

Some implementations require that a tubing pressure test be performed for a specified period of time before wellbore fluid is introduced into the formation. As can be seen from the discussion above, some of the current toe sleeves 60 either open instantly or use a time delay by forcing hydraulic fluid through a restrictor device to slow the opening of the sleeve 60. Historically, oil wells have simply tested their tubing at a lower pressure than the pressure actually required to open the toe sleeve 60. Unfortunately, new leak paths can be created by increasing the tubing pressure to open the toe sleeve 60 above the test value used in the tubing pressure test. For this reason, more recent methods for opening toe sleeves attempt to delay the opening of the toe sleeve to allow a higher pressure tubing test to be performed before actually opening the toe sleeve. This overcomes the problems associated with over-pressurizing the tubing in order to open the toe sleeve.

Even though such systems have been effective, operators are continually striving for new and useful ways to open a toe sleeve downhole for fracture operations or the like. The subject matter of the present disclosure is directed to overcoming, or at least reducing the effects of, one or more of the problems set forth above.

SUMMARY OF THE DISCLOSURE

According to the present disclosure, a downhole tool is actuatable in response to applied pressure. The tool includes a housing, an insert, and at least one retainer. The housing defines a housing bore therethrough. The housing has a communication path extending from a first part of the housing bore to a second part of the housing. The insert is movably disposed in the housing bore. The at least one retainer is engaged between the insert and the housing and is at least partially composed of a dissolvable material. The at least one retainer at least partially dissolves in response to the applied pressure communicated through the communication path to the second part and permits the applied pressure to initiate movement of the insert.

The tool can be a toe sleeve or the like and can define at least one port communicating the housing bore outside the housing. The insert is movable from a first position covering the at least one port to a second position uncovering the at least one port. In this case, the at least one retainer at least partially dissolved can permit the applied pressure to initiate movement of the insert from the first position to the second position.

The dissolvable material of the at least one retainer can be selected from the group consisting of a polystyrene, an elastomer, a resin, an adhesive, a polyester, a polymide, a thermoplastic polymer, a polyglycolide, a polyglycolic acid, a thermosetting polymer, an aluminum, and a reactive metal. In one arrangement, the at least one retainer comprises a coating of non-dissolvable material covering the dissolvable material. The coating is breachable in response to the applied pressure. For example, the non-dissolvable material can be selected from the group consisting of a ceramic, a metal, and a plastic.

The at least one retainer can be engaged between a first shoulder disposed on the insert and a second shoulder disposed on the housing. The first and second shoulders can be spaced from the at least one retainer and can permit partial movement of the insert toward the second position in response to the applied pressure. In this way, the insert partially moved toward the second position can initiate dissolving of the dissolvable material of the at least one retainer. For instance, the partial movement can breach the coating on the at least one retainer so that the at least one retainer can begin to dissolve.

The at least one retainer can include one or more keys disposed in one or more windows on the insert and engaged in one or more slots in the second part of the housing bore. The insert can be biased toward the second position by a differential pressure between the applied pressure in first part and a sealed pressure in the second part of the communication path.

The insert can include at least one retention device, such as a shear pin or the like, at least temporarily holding the insert in the first position and being breakable in response to a level of the applied pressure acting against the insert. The insert can include a lock engageable with the housing bore when the insert is in the second position. Finally, the insert can include first and second seals sealing against the housing bore on both sides of the at least one port when the insert is in the first position.

The housing can include a barrier disposed between the first and second parts of the communication path. The barrier is breachable in response to a level of the applied pressure in the housing bore. Use of the barrier can be beneficial in preventing premature dissolving of the at least one retainer. Depending on operations, however, the tool does not necessarily require such a barrier.

The second part of the communication path in the housing can be exposed to the housing bore, especially where the at least one retainer exposed in the second part engages the insert. In this case, the insert sealably encloses the second part of the communication path.

The housing can include at least one seal disposed in the second part of the communication path and engaging a portion of the insert. Finally, the housing can include a sealed chamber defined between the housing bore and the insert in the first position and decreasing in volume with movement of the insert from the first position to the second position.

According to the present disclosure, a downhole tool is actuatable in response to applied pressure. The tool has a housing, an insert, a barrier, and at least one retainer. As before, the housing defines a housing bore therethrough and defines at least one port communicating the housing bore outside the housing. The housing has a communication path extending from a first part of the housing bore to a second part of the housing bore.

As before, the insert is movably disposed in the housing bore and sealably encloses the second part of the communication path. The insert is movable from a first position covering the at least one port to a second position uncovering the at least one port.

The barrier is disposed between the first and second parts of the communication path and is breachable in response to a level of the applied pressure in the housing bore. The at least one retainer engaged between the insert and the housing at least temporarily retains the insert toward the first position. However, the at least one retainer is at least partially composed of a dissolvable material. Therefore, the at least one retainer at least partially dissolves in response to the applied pressure communicated through the communication path to the second part when the barrier is breached. The at least one retainer when at least partially dissolved permits the applied pressure to initiate movement of the insert from the first position to the second position.

According to the present disclosure, a downhole tool actuatable in response to applied pressure can include a dissolvable retainer with a coating thereon, and the tool can have a breachable barrier that separates the retainer from communicated fluid until breached. In other arrangements, the downhole tool can have a dissolvable retainer with a coating, but may not have a barrier. In still other arrangements, the tool can have a dissolvable retainer without a coating, but the tool can have a barrier, or the tool can have a dissolvable retainer without a coating and without a barrier.

According to the present disclosure, a method is used for opening a sleeve on a tubing string. An insert is held toward a closed condition in the sleeve with at least one retainer. Pressure is applied down the tubing string to the sleeve, and the at least one retainer at least partially dissolves in response to the applied pressure. The hold of the insert toward the closed condition is released in response to the at least partially dissolving of the at least one retainer, and the insert shifts toward an opened condition in the sleeve with the applied pressure.

To apply the pressure down the tubing string to the sleeve, a breachable barrier in the sleeve can be breached between a bore of the sleeve and an internal space in the sleeve. The at least one retainer can then at least partially dissolve in response to the applied pressure in the internal space of the sleeve. To at least partially dissolve the at least one retainer, a coating protecting a dissolvable material of the at least one retainer can be broken in response to the applied pressure at least partially shifting the insert from the closed condition toward the opened condition. Overall, shifting the insert toward the opened condition in the sleeve with the applied pressure can involve exposing the insert to a pressure differential between the applied pressure and a sealed chamber defined by the insert with a bore of the sleeve.

The foregoing summary is not intended to summarize each potential embodiment or every aspect of the present disclosure.

DETAILED DESCRIPTION OF THE DISCLOSURE

Figure 1:
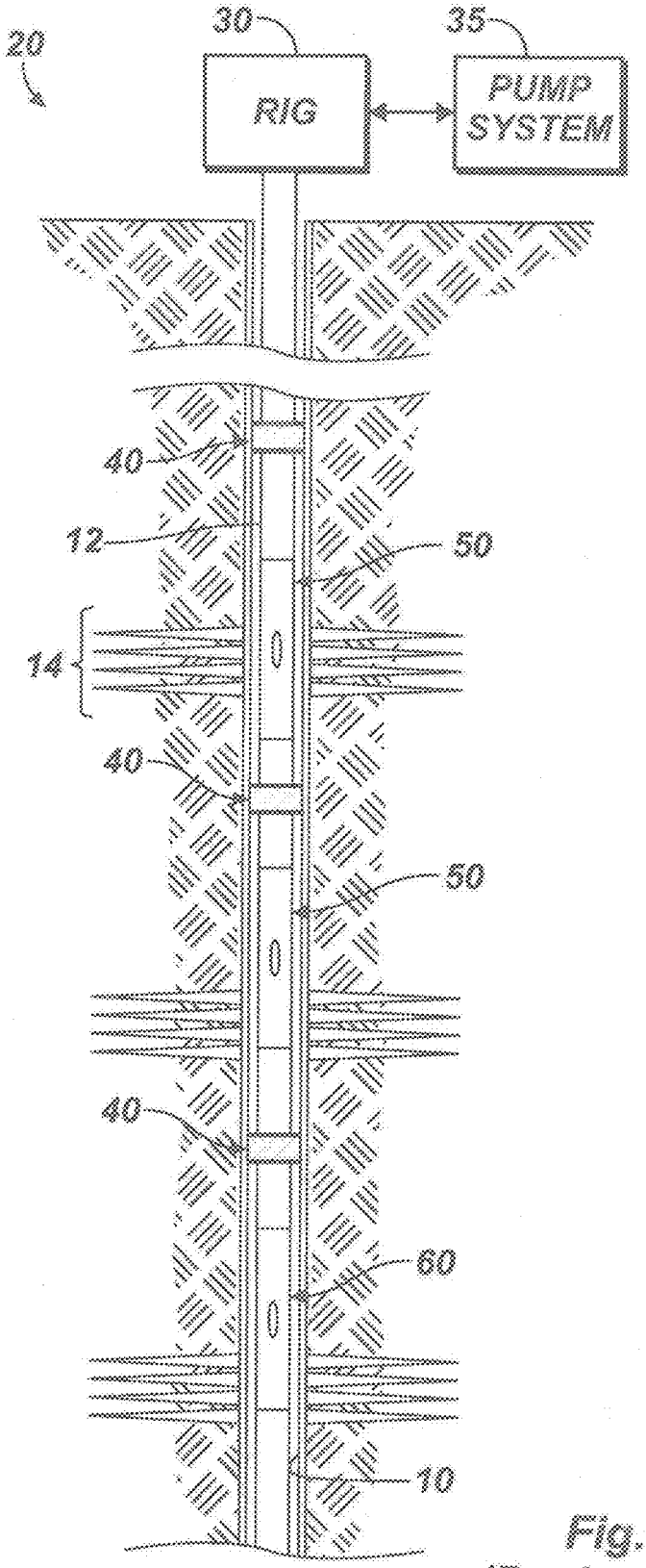
FIG. 1 illustrates a tubing string having sliding sleeves and a toe sleeve as background to the present disclosure.
Figures 2A, 2B, 2C:
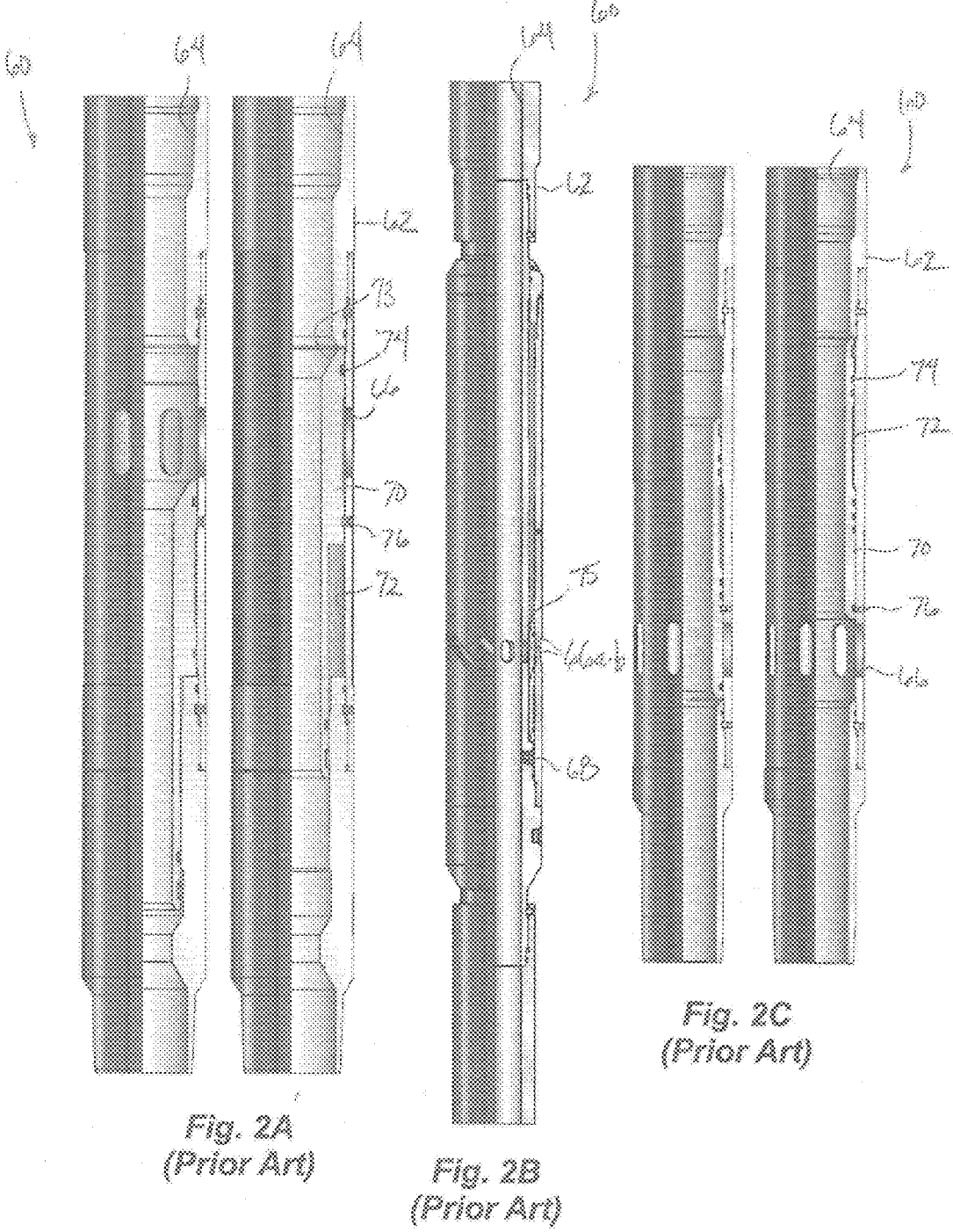
Fig. 2A (Prior Art)
Fig. 2B (Prior Art)
Fig. 2C (Prior Art)
FIGS. 2A-2E illustrate various toe sleeves according to the prior art in partial cross-section.
Figure 2D:
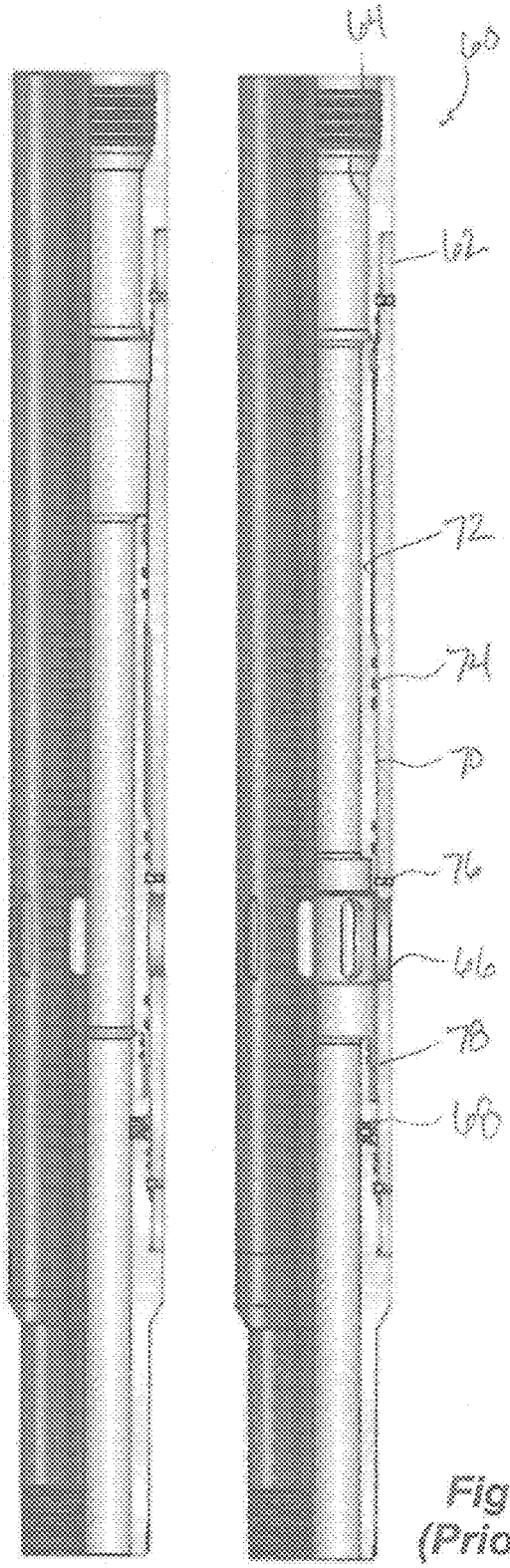
Fig. 2D (Prior Art)
Figure 2E:
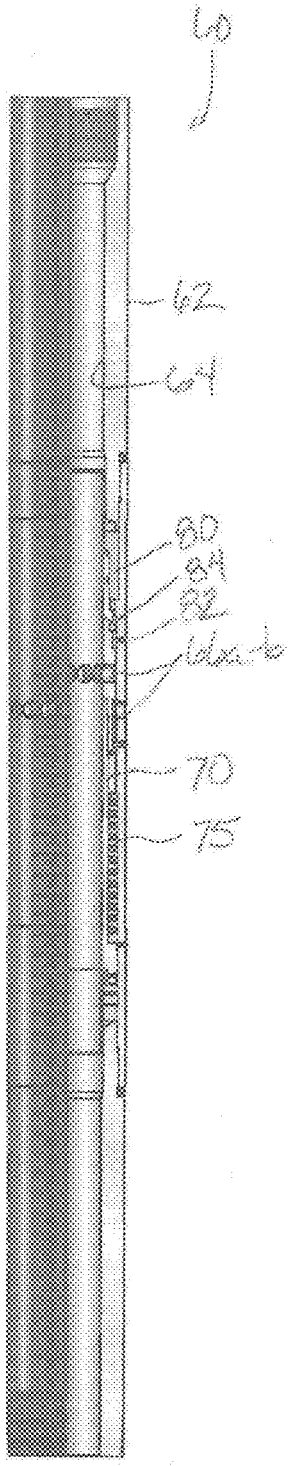
Fig. 2E (Prior Art)
Figure 3A:
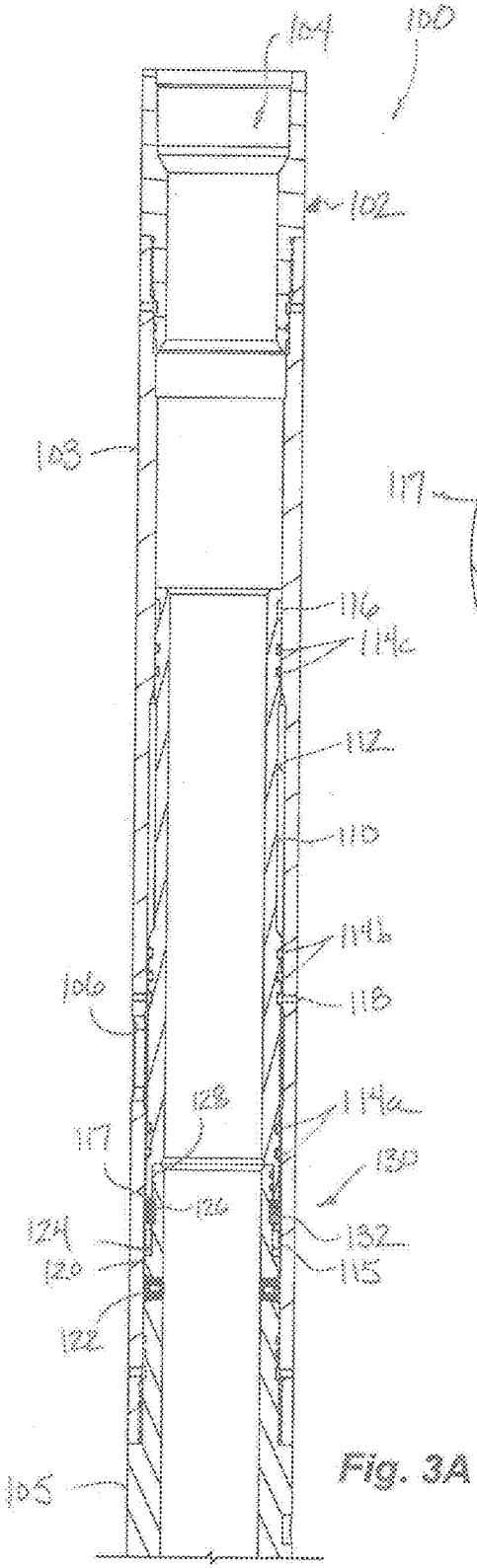
FIG. 3A illustrates a cross-sectional view of a toe sleeve according to the present disclosure.
Figure 3B:
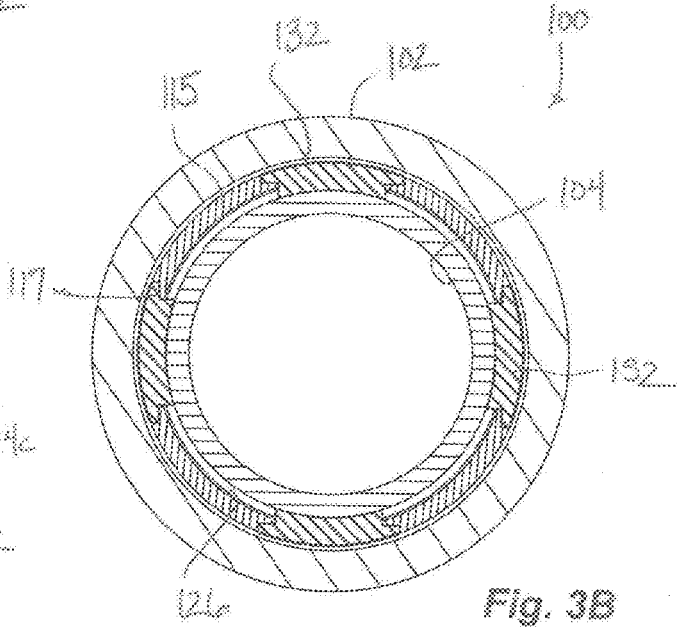
FIG. 3B illustrates an end-section of the disclosed toe sleeve.
Figure 3C:
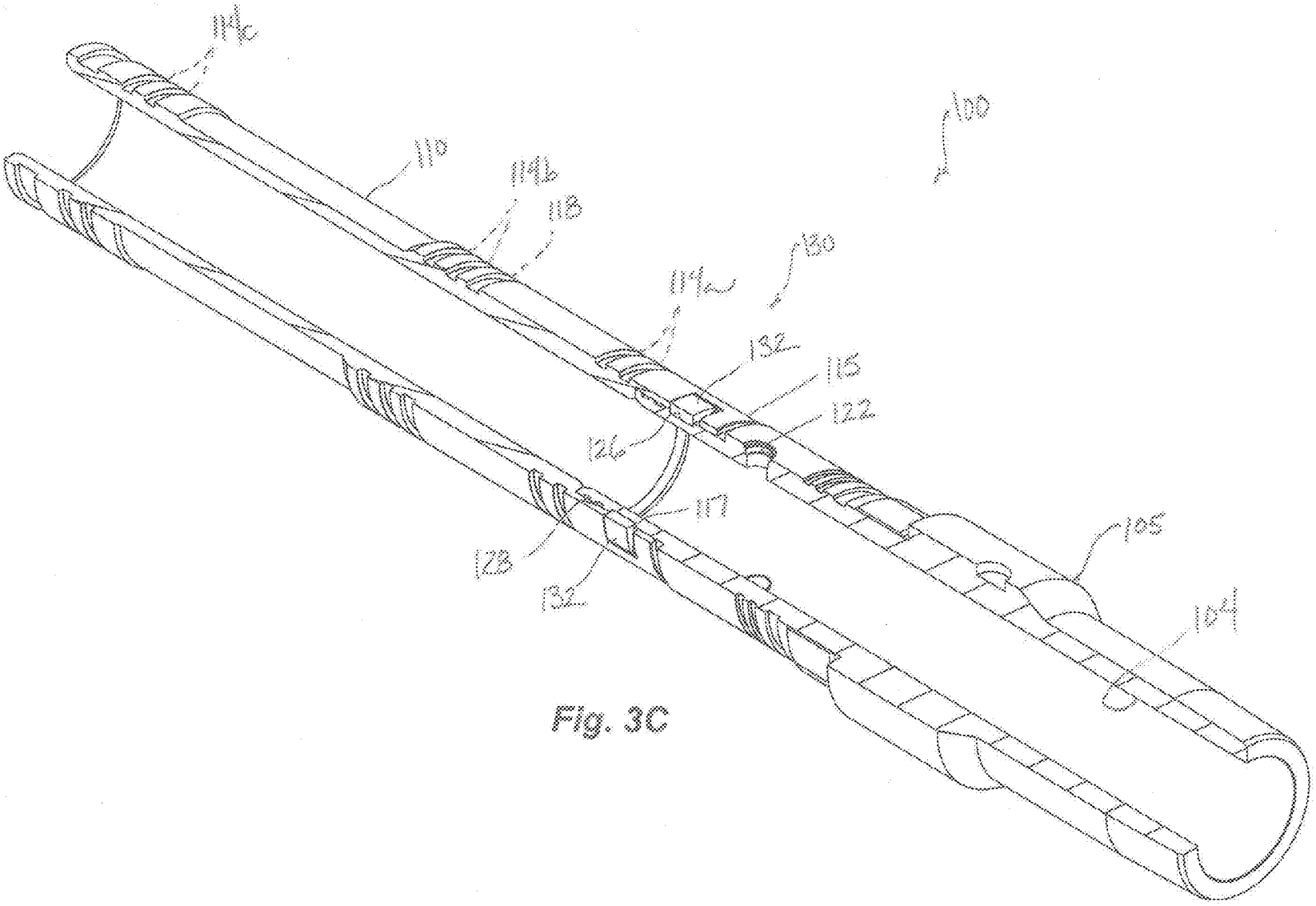
FIG. 3C illustrates a perspective view of the disclosed toe sleeve in partial cutaway.
Figure 5A:
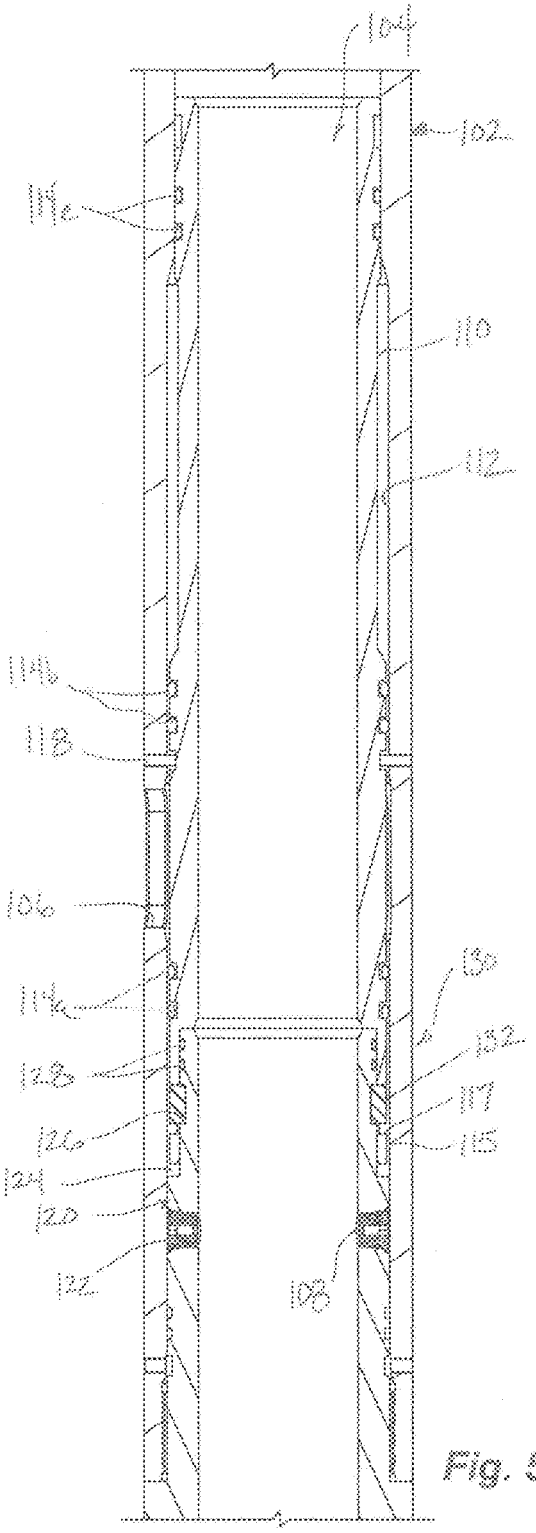
FIGS. 5A-5B illustrate the disclosed toe sleeve during stages of operation.
Figure 5B:
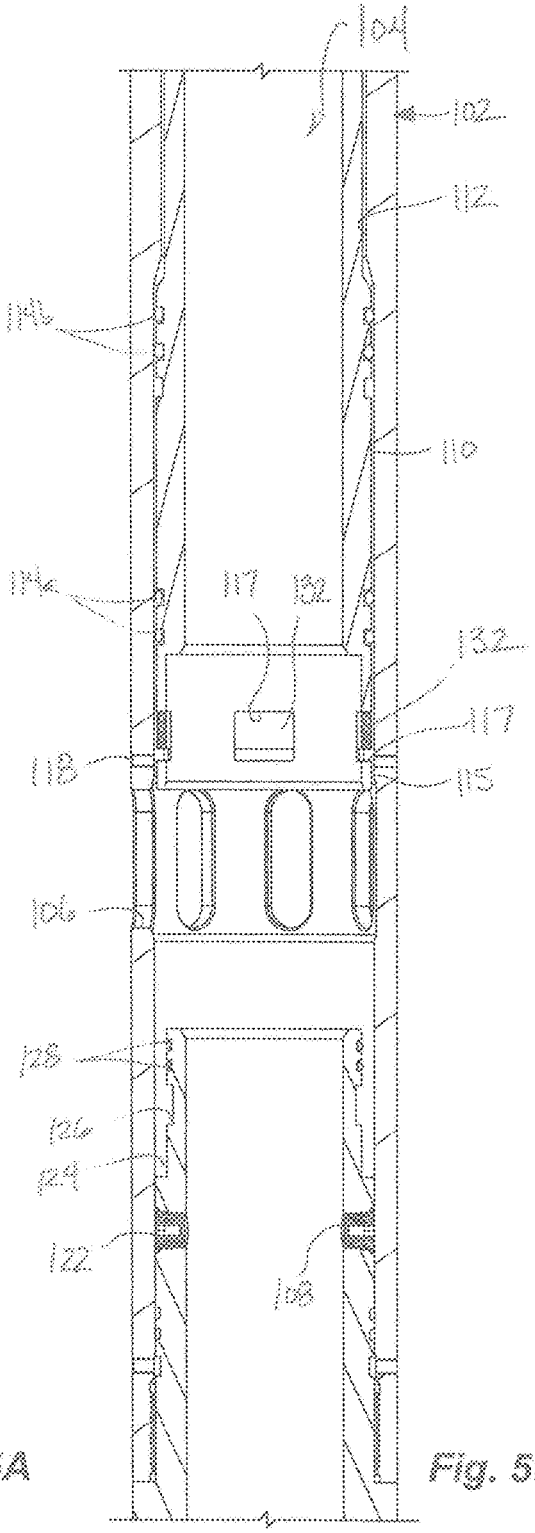

With a general understanding of how a toe sleeve is used, attention now turns to details of a toe sleeve according to the present disclosure. In particular, FIGS. 3A-3C illustrate a downhole tool or toe sleeve 100 according to the present disclosure in cross-section, end-section, and cutaway perspective, and FIGS. 5A-5B illustrate portions of the disclosed toe sleeve 100 during stages of operation. The toe sleeve 100 is actuatable in response to applied pressure down the tubing string in a completion system, such as discussed previously.

The toe sleeve 100 includes a housing 102 defining a housing bore 104 therethrough and defining at least one port 106 communicating the housing bore 104 outside the housing 102. For assembly purposes, the housing 102 can have a first housing portion 103 that couples to a second housing portion 105. In any event, the housing 102 has a communication path 120 extending from the housing bore 104, through internal openings 122, and to an internal space 124 defined in the housing bore 104.

An insert 110 is movably disposed in the housing bore 104 and has a distal end 115 sealably enclosing the internal space 124 of the communication path 120. In particular, the insert's distal end 115 engages seals 128 disposed in the internal space 124.

The insert 110 is movable from a first position (FIGS. 3A & 5A) covering the at least one port 106 to a second position (FIG. 5B) uncovering the at least one port 106. When the insert 110 is in the first, closed position (FIGS. 3A & 5A), the insert 110 has first and second seals 114*a-b* sealing against the housing bore 104 on both sides of the at least one port 106 so fluid in the bore 104 does not pass out of the housing 102.

The insert 110 also has second and third seals 114*b-c* that in the first position (FIG. 5A) define a sealed chamber 115 with the housing bore 104. The volume of this sealed chamber 115 can be at atmospheric pressure and can assist in the movement of the insert 110 from the first position (FIG. 5A) to the second position (FIG. 5B) during operation. Finally, the insert 110 comprises a lock 116 engageable with the housing bore 104 when the insert 110 is in the second position (FIG. 5B) to lock the insert 110 open.

Movement of the insert 110 from the closed position (FIG. 5A) to the opened position (FIG. 5B) is controlled by pressure applied down the tubing string (not shown) to the housing bore 104. In fact, to time movement of the insert 110 for a period after applying the pressure, the insert 110 is retained in its first closed position (FIGS. 3A & 5A) using dissolvable retention 130. The time delay involved by the dissolvable retention 130 can be configured based on the types of materials used, the conditions involve in causing dissolution, how the material dissolves, and a number of other factors.

As shown here, the dissolvable retention 130 includes at least one retainer 132 engaged between the insert portion (i.e., distal end 115) and the housing 102 and being at least partially composed of a dissolvable material. The at least one retainer 132 dissolves in response to the applied pressure communicated through the communication path 120 to the internal space 124 and permits the applied pressure to move the insert 110 from the closed position (FIGS. 3A & 5A) to the opened position (FIG. 5B).

To initially control communication of the applied pressure, a breachable barrier, such as an arrangement of rupture discs 108, can be disposed between the housing bore 104 and the internal space 124. In particular, the rupture discs 108 are disposed in the path's internal openings 122 in the housing 102 that communicate the housing bore 104 with the internal space 124. A specified level of pressure applied in the housing bore 104 can breach the rupture discs 108 so the applied pressure can then enter the internal space 124 and act against the insert 110 and the dissolvable retention 130. Depending on the operations, the pressures involved, and the materials used, the breachable barrier 108 may not be necessary. However, at a minimum, the breachable barrier 108 can prevent premature or unexpected operation of the tool 100.

At least one shear pin 118 or other retention device may also at least temporarily hold the insert 110 in the first position (FIGS. 3A & 5A) and may be breakable or shearable in response to a level of the applied pressure against the insert's distal end 115 at the internal space 124 in communication with the rupture disc 108. Use of such shear pins 118 may not be necessary depending on the retention provided by the retention 130. Either way, the dissolvable retention 130 prevents the insert 110 from shifting until the retention 130 has dissolved sufficiently to either no longer contact a mating component or become unable to carry the load from the applied pressure. At this point, the sleeve's insert 110 can open.

As best shown in FIGS. 3B and 3C, the dissolvable retention 130 includes a plurality of the retainers or keys 132 disposed in windows 117 at the distal end 115 of the insert 110. In the end-section of FIG. 3B, for example, a set of four such keys 132 can be disposed about the distal end 115 in the windows 117. External details of the windows 117 on the insert's distal end 115 are best shown in the prospective, exposed view of FIG. 3C, which does not depict the first housing portion (103) of the toe sleeve 100.

Figure 4:
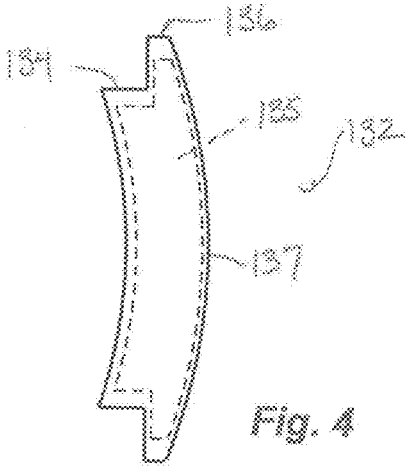
FIG. 4 illustrates an end view of a retainer for the disclosed toe sleeve.

As shown in FIG. 4, each key 132 can have an inner end 134 and a flanged end 136. As shown in FIGS. 3A-3B, the inner ends 134 on the keys 132 can fit against retention shoulders or slots 126 defined in the housing 102. Accordingly, the keys 122 are engaged between the first shoulders or windows 117 disposed on the insert's distal end 115 and the second shoulders or slots 126 disposed on the housing 102.

In one arrangement, the keys 132 are composed entirely of a dissolvable material that starts dissolving when exposed to certain conditions, such as fluid pressure, temperature, particular fluid, solvent, etc. In the context of the present disclosure, for example, the dissolvable material can start dissolving when exposed to fluid when the barrier 108 (if present) is breached by applied pressure or can start dissolving directly when exposed to some condition regardless of whether a barrier 108 is used or not.

Reference herein to dissolvable material is meant to encompass any materials designed to dissolve, erode, disintegrate, or otherwise degrade in certain wellbore conditions due to heat, temperature, hydrocarbon composition, introduced solvent, applied acid, or other factors. By having a dissolvable material, the physical properties of the keys 132 are generally degraded to a point where the keys 132 no longer function as intended—e.g., can no longer retain the insert 110. This produces a time delay between an initial point in time when the keys 132 are exposed to the dissolving condition and a later point in time when the keys 132 no longer function and loose hold of the insert 110. Generally speaking, the dissolvable materials can include one or more of polystyrenes, elastomers, resins, adhesives, polyesters, polymides, thermoplastic polymers, polyglycolide, polyglycolic acid, thermosetting polymers, an aluminum, and a reactive metal to name just a few.

In another arrangement schematically depicted in FIG. 4, the keys 132 (or any other form of retention 130 disclosed herein) can have a coating 137 of non-dissolvable material covering a dissolvable material 135 forming the body of the key 132. For its part, the coating 137 can be breached in response to the applied pressure, physical impact, compression, etc. As such, the coating 137 can be composed of a ceramic, a metal, a plastic, etc. In the context of the present disclosure, for example, the covering can be breached when exposed to fluid when the barrier 108 (if present) is breached by applied pressure or can start be breach directly when exposed to some condition regardless of whether a barrier 108 is used or not.

In this arrangement of the coated keys 132, the shoulders of the windows 117 and slots 126 are spaced to permit partial movement of the insert 110 toward the opened position in response to the initially applied pressure. The insert 110 partially moved toward the opened position then initiates the dissolving of the dissolvable material of the keys 132, for example, by breaking the coating 137 and exposing the dissolvable material 135. This arrangement also produces a time delay between an initial point in time when the coating of the keys 132 are breached so the dissolving condition can begin and a later point in time when the keys 132 no longer function and loose hold of the insert 110. Breaching the coating can occur at the same time or some time after the breaching of any barrier 108, if present.

FIGS. 5A-5B illustrate the disclosed toe sleeve 100 during stages of operation. As can be seen in FIG. 5A, the insert 110 is primarily retained in its first (closed) position using the set of keys 132. Retained by the shoulders of the windows 117 and slots 126, the keys 132 create an interference fit when the insert 110 tries to shift open due to applied pressure in the tubing acting on the piston differential created by the insert's seals 114*b-c* and the chamber 112.

As noted above, the keys 132 are preferably made of the dissolvable material 135 and can have the protective coating 137 to prevent premature dissolution. When in the run-in position (FIG. 5A), there is enough space in the window 117 for the keys 132 that the insert 110 can shift a fraction when pressure is first applied against the distal end 115 in the internal space 124 from the breached discs 108. This pressure can provide enough force to crack or breach the protective coating 137 on the keys 122 and begin the dissolving process of the dissolvable material 135.

Depending on the dissolving material used, the keys 132 may dissolve directly in response to the applied fluid in the tubing string. Alternatively, a solvent can be introduced into the applied fluid. Additionally, since the keys 132 are contained within the internal space 124, any solvent can be initially contained within the internal space 124 so the solvent does not need to be applied from surface.

When the keys 132 have sufficiently dissolved, they may no longer adequately engage the shoulders of the windows 117 and slots 126. The applied pressure at the insert's sealed distal end 115 at the space 124 then acts on the insert 110 against the differential pressure of the defined chamber 112. Sufficient pressure can then shift the insert 110 open upward, as shown in FIG. 5B. At this point, applied fluid can pass out of the housing 102 through the now open port 106.

Depending on the number of retainers or keys 132 used, the way they dissolve, their strength, and the like, use of the breachable discs 108 and/or shear pins 118 may or may not be necessary or desired.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool actuatable in response to applied pressure of fluid, the tool comprising:

a housing defining a housing bore therethrough, the housing having a communication path extending from a first part of the housing bore to a second part of the housing bore;

an insert movably disposed in the housing bore;

at least one retainer engaged between the insert and the housing, the at least one retainer at least temporarily retaining the insert in a first position in the housing bore and being at least partially composed of a dissolvable material; and a barrier disposed in the communication path between the first and second parts of the housing bore and being breachable in response to a level of the applied pressure in the first part, the breached barrier permitting the fluid to communicate through the communication path to the second part, the at least one retainer at least partially dissolving in response to the fluid communicated through the communication path to the second part and permitting movement of the insert from the first position to a second position.

2. The tool of claim 1, wherein the housing defines at least one port communicating the housing bore outside the housing, wherein the insert is movable from the first position covering the at least one port to the second position uncovering the at least one port, and wherein the at least one retainer at least partially dissolved permits the movement of the insert from the first position to the second position.

3. The tool of claim 1, wherein the dissolvable material of the at least one retainer is selected from the group consisting of a polystyrene, an elastomer, a resin, an adhesive, a polyester, a polymide, a thermoplastic polymer, a polyglycolide, a polyglycolic acid, a thermosetting polymer, an aluminum, and a reactive metal.

4. The tool of claim 1, wherein the at least one retainer comprises a coating of non-dissolvable material covering the dissolvable material, the coating being breachable in response to the applied pressure.

5. The tool of claim 4, wherein the non-dissolvable material is selected from the group consisting of a ceramic, a metal, and a plastic.

6. The tool of claim 1, wherein the at least one retainer is engaged between a first shoulder disposed on the insert and a second shoulder disposed on the second part of the housing bore.

7. The tool of claim 6, wherein the first and second shoulders are spaced from the at least one retainer and permit partial movement of the insert toward the second position, the insert partially moved toward the second position initiating dissolving of the dissolvable material of the at least one retainer.

8. The tool of claim 7, wherein the at least one retainer comprises a coating of non-dissolvable material covering the dissolvable material, the coating being breachable in response to the partial movement of the insert toward the second position.

9. The tool of claim 1, wherein the at least one retainer comprises one or more keys disposed in one or more windows on the insert and engaged in one or more slots in the second part of the housing bore.

10. The tool of claim 1, wherein the insert defines a sealed chamber with the housing bore; and wherein the insert is biased toward the second position by a differential pressure between the insert and the sealed chamber.

11. The tool of claim 1, wherein the insert comprises at least one of:

at least one retention device at least temporarily holding the insert in the first position and being breakable in response to the movement to the second position;

a lock engageable with the housing bore when the insert is in the second position; and first and second seals sealing against the housing bore on both sides of the at least one port when the insert is in the first position.

12. The tool of claim 1, wherein the insert in the first position sealably closes off the communication path at the second part of the housing bore.

13. The tool of claim 1, wherein the housing comprises at least one of:

at least one seal disposed in the second part of the housing bore and engaging a portion of the insert; and a sealed chamber defined between the housing bore and the insert in the first position and decreasing in volume with the movement of the insert from the first position to the second position.

14. A downhole tool actuatable in response to applied pressure of fluid, the tool comprising:

a housing defining a housing bore therethrough and defining at least one port communicating the housing bore outside the housing, the housing having a communication path extending from a first part of the housing bore to a second part of the housing bore;

an insert movably disposed in the housing bore and sealably enclosing the communication path at the second part of the housing bore, the insert being movable from a first position covering the at least one port to a second position uncovering the at least one port;

a barrier disposed between the first and second parts of the communication path and being breachable in response to a level of the applied pressure in the housing bore, the breached barrier permitting the fluid to communicate through the communication path to the second part; and at least one retainer engaged between the insert and the second part of the housing bore and at least temporarily retaining the insert toward the first position, the at least one retainer being at least partially composed of a dissolvable material and at least partially dissolving in response to the fluid communicated through the communication path to the second part, the at least one retainer being at least partially dissolved permitting movement of the insert from the first position to the second position.

15. The tool of claim 14, wherein the at least one retainer comprises a coating of non-dissolvable material covering the dissolvable material, the coating being breachable in response to the applied pressure.

16. A method of opening a sleeve on a tubing string, the method comprising:

holding an insert toward a closed condition in the sleeve with at least one retainer;

applying pressure of fluid down the tubing string to the sleeve;

breaching, in response to the applied pressure, a breachable barrier in the sleeve between a bore of the sleeve and an internal space in the sleeve;

at least partially dissolving the at least one retainer in response to the breached barrier;

releasing the hold of the insert toward the closed condition in response to the at least partially dissolving of the at least one retainer; and shifting the insert toward an opened condition in the sleeve in response to the released hold.

17. The tool of claim 14, wherein the at least one retainer is engaged between a first shoulder disposed on the insert and a second shoulder disposed on the second part of the housing bore, the first and second shoulders permitting partial movement of the insert toward the second position to breach a non-dissolvable coating on the at least one retainer and initiate dissolving of the dissolvable material of the at least one retainer.

18. The tool of claim 14, wherein the insert defines a sealed chamber with the housing bore; and wherein the insert is biased toward the second position by a differential pressure between the insert and the sealed chamber.

19. The method of claim 16, wherein at least partially dissolving the at least one retainer comprises at least partially dissolving the at least one retainer with the fluid communicated in the internal space of the sleeve.

20. The method of claim 16, wherein at least partially dissolving the at least one retainer comprises breaking a coating protecting a dissolvable material of the at least one retainer.

21. The method of claim 20, wherein breaking the coating protecting the dissolvable material of the at least one retainer comprises at least partially shifting the insert from the closed condition toward the opened condition with the applied pressure.

22. The method of claim 16, wherein shifting the insert toward the opened condition in the sleeve comprises exposing the insert to a pressure differential between the applied pressure and a sealed chamber defined by the insert with a bore of the sleeve.

* * * * *